United States Patent [19]

Lenk et al.

[11] 4,153,211

[45] May 8, 1979

[54] BOBBIN ELEVATORS IN BOBBIN TRANSPORT DEVICES

[75] Inventors: Erich Lenk; Manfred Mayer; Gerd Münnekehoff, all of Remscheid, Fed. Rep. of Germany

[73] Assignee: Barmag Barmer Maschinenfabrik AG, Remscheid-Lennep, Fed. Rep. of Germany

[21] Appl. No.: 785,854

[22] Filed: Apr. 8, 1977

[30] Foreign Application Priority Data

Apr. 15, 1976 [DE] Fed. Rep. of Germany ..... 2616852

[51] Int. Cl.[2] ..... B65H 54/20; B65H 67/06

[52] U.S. Cl. ..... 242/35.5 A; 242/41; 414/634; 414/911

[58] Field of Search ..... 242/35.5 A, 35.5 R, 242/18 R, 41, 54 R, 58.6, 79; 57/52, 53; 214/1 D, 1 BC, 671, 730, 95 R, DIG. 1, DIG. 4

[56] References Cited

U.S. PATENT DOCUMENTS

| | | | |
|---|---|---|---|
| 854,961 | 5/1907 | McCarthy | 214/671 |
| 3,729,102 | 4/1973 | Shumaker | 242/54 R |
| 3,858,736 | 1/1975 | French, Jr. et al. | 214/671 |
| 3,881,603 | 5/1975 | Stotler et al. | 214/1 D |
| 3,964,723 | 6/1976 | Schippers et al. | 242/35.5 A |
| 3,999,665 | 12/1976 | Rogers | 214/DIG. 4 |
| 4,023,743 | 5/1977 | Schippers | 242/35.5 A |
| 4,039,092 | 8/1977 | Schar | 242/35.5 A X |
| 4,041,686 | 8/1977 | Inaba et al. | 242/35.5 A X |

*Primary Examiner*—Stanley N. Gilreath
*Attorney, Agent, or Firm*—John H. Shurtleff

[57] ABSTRACT

Bobbin transport devices with a swingable carrier and a bobbin receiving member adapted in a first pivot position to align with a bobbin on a winding machine, a second swingable carrier with its own bobbin receiving member which aligns with the first bobbin receiving member, a shifting member for varying the distance between the two bobbin receiving members, e.g., a piston rod adapted to engage the bobbin on a slide or trolley member for one swingable carrier, and a rack and pinion or pressurized fluid operated lift for the aforementioned structures.

18 Claims, 8 Drawing Figures

BOBBIN ELEVATORS IN BOBBIN TRANSPORT DEVICES

This invention pertains to bobbin transport devices which serve the purpose of taking bobbins from bobbin spindles of a winding machine and transferring them, for example, to a bobbin receiving carriage, a bobbin creel or the like. The bobbins so transferred often must be conveyed from one level to a higher or lower level while also being moved horizontally. Bobbin transport devices of this type are known as bobbin elevators and are especially useful for the handling and shifting of heavy bobbins, thereby eliminating the need for heavy manual labor and/or speeding up the time required for a bobbin change by the operating personnel. These bobbin transport devices may be used in conjunction with machines for the production, for the processing or for the winding of sheet-type structures, e.g., fabric webs, foil webs, paper webs, fleece webs, etc. and of filamentary structures, e.g., continuous filaments, yarns, threads, ribbons, ropes, wires, cables, etc.

As is well known, the bobbins or winding machines must be changed at regular intervals. In today's technology, full bobbins are removed from the machines and/or empty bobbins are placed on the machines at the respective winding stations by a bobbin carrier. In order to handle a plurality of bobbins at different winding stations, e.g., stations at different horizontal levels, the bobbin carriage has a plurality of bobbin receiving and transport members also positioned at different vertical levels. In the case of heavy bobbins, the loading or unloading of such a bobbin carrier requires considerable manual effort as well as a relatively long time. For this reason, manufacturers of the aforesaid types of structures have endeavored to aid mechanically the manual labor involved in bobbin changes, either by shortening it or by dispensing with it.

For these reasons, automatic bobbin changers have been developed. These automatic bobbin changers require skilled technical personnel and are relatively costly both in their manufacture and maintenance. Uses of such automatic bobbin changers, accordingly, are limited by these economic factors. Further, automatic bobbin changers have technical limitations, particularly for the winding of webs or filamentary structures in which, due to the design of the overall plant, the winding cannot be interrupted. In these cases, a failure by the bobbin changer can lead not only to complete cessation of the production lines served by the bobbin changer but also to possible damage of the production facilities.

The bobbins for filamentary structures, e.g., yarns, usually have a thread reserve, i.e., a thread filament or yarn protruding from the innermost wound layer of the winding in the form of a parallel winding of a few turns on the end of the tube. This thread reserve is used to tie the end of the thread filament or yarn to the thread filament or yarn to be drawn off from the next or successor bobbin winding. By so doing, the machine used to further process such bobbin-wound threads, filaments or yarns can continue to run without interruption and at full operating speed.

To form a thread reserve, most winding machines have special components (German Pat. No. 24 61 223; German Offen. No. 25 47 401). The thread reserve forming device on the winding machine functions to provide a thread reserve which lies at a particular end of the bobbin.

When a wound bobbin with a thread reserve winding is shifted during bobbin change in its axial direction onto the bobbin receiving member of a bobbin transport device and from the latter, after swinging of the bobbin receiving member, onto a receiving mandrel of a bobbin receiving carriage or a bobbin creel, under some circumstances the thread reserve ends up on the side of the bobbin carriage or creel opposite to the operating side thereof and is accessible to operating personnel only with difficulty.

It is an object of this invention to provide a bobbin transport device in which the bobbins can be manipulated in such a way that the orientation of the bobbin, upon its shift onto the receiving mandrel of the carriage or creel, can be chosen, e.g., the thread reserve winding can be remote from or adjacent to the free end of the mandrel. Another object of the invention is to provide an elevator mechanism in association with the bobbin-swinging members, such elevator having a manual labor-reducing function in the removal of the bobbins and their transport from one level to another and the lift drive being shifted and operated manually.

A further object of the invention is to provide such a manually operated bobbin elevator with a vertically movable slide and a gripper thereon, preferably in the form of a lift drive in which the hand movements by the operating personnel are equidirectional and proportional to the up and down movement of the elevator slide. Another object is to provide bobbin elevator mechanisms which do not require manual force but which, with the hand movement for the operation of the elevator slide, provide simultaneously a speed control proportional to the hand movement. Still another object is to provide elevator lift structures of the latter type utilizing a pneumatic elevator drive enabling the exact positioning of the bobbin gripper to facilitate the loading of the gripper with heavy bobbins.

Still another object of the invention is to provide structures which integrate the bobbin elevator in a bobbin transport device of the type described above, whereby a wound bobbin is taken from the bobbin spindle of the winding machine and transferred in the desired orientation of the bobbin at a correct height onto the mandrel of a bobbin receiving carriage or creel.

These objects are realized by bobbin transport units having a swingable carrier with a bobbin receiving member adapted, in its first pivoted position, to align with a wound bobbin at a respective winding station of a winding machine. Such bobbin transport device is characterized by having a second swingable carrier with its own bobbin receiving member. The latter is adapted to be aligned with the first bobbin receiving member when the latter is in its second pivoted position coupled with shifing means by which the horizontal distance between the two bobbin receiving members may be varied. Such shifting means may be one which engages and acts on the bobbin or its winding or it may embody a slide or trolley having thereon a swingable, releasable auxiliary bobbin carrier associated with the first-mentioned bobbin receiving member. A second auxiliary carrier has means for clampingly engaging such first-mentioned bobbin receiving member, the bobbin receiving member preferably being a mandrel.

One embodiment of the elevator is manually operated. It has a lift slide and an associated gripper as well as a pneumatic drive for the lift slide. Such elevator is characterized by a follower slide which moves synchronously with the lift slide. The follower slide can be stopped in fixed position on the vertical slide support by a brake. A spring extends laterally from the follower slide and is deflectable in the vertical plane. A handle is mounted on the spring. There is a measuring unit for measuring the spring deflection with respect to the lift slide, such measuring arrangement being connected with the lift drive in such a way that the spacing between the lift slide and the spring is regulated to maintain a constant value. A switch for operating the brake is located in the area of the handle, such switch preferably operating to release or set the brake at prescribed deflections of the spring. The pneumatic lift drive utilizes a pneumatic cylinder-piston structure, the lift slide being connected to the piston.

The lift slide carries a laterally projecting arm which in turn carries the bobbin gripper, e.g., a mandrel. The spring preferably is a springable cantilever beam extending parallel to the carrying arm. The lift slide, the lift drive and the follower preferably are mounted on a common column, the base of which is rotatably mounted for the purpose of effecting pivotal movement of the carrying arm with the column and members thereon rotating about a vertical axis.

In a further embodiment of the bobbin elevator, the swingable carrying arm for the bobbins has a swingable auxiliary carrier which is slidable on the carrying arm and swingable with said arm. An associated bobbin shifting unit is used to slide the auxiliary carrier along the arm to transfer the wound bobbin from a bobbin holder on the auxiliary carrier to a bobbin holder on the carrying arm. Most preferably, the shifting unit is a trolley movable along the carrying arm, on which trolley the auxiliary carrier with its bobbin holder is pivotally mounted. The bobbin receiving member, e.g., a mandrel, is releasably held on the auxiliary carrier. A receptacle for the free end of the bobbin receiving member is provided on the carrying arm, whereby transfer of the wound bobbin and its bobbin receiving member from the carrier to the arm is achieved when the bobbin receiving member has its free end inserted in the receptacle, after which the auxiliary carrier is withdrawn.

The subject invention makes it possible, without heavy manual labor by operating personnel and without damage to the outer layers of the winding, to slide a bobbin off the bobbin transport device in such a way that the thread reserve winding on one end of the winding tube is oriented in the desired position when the wound bobbin is placed on the bobbin carriage or creel. The embodiment which integrates the bobbin elevator and the carrying arm with the aforesaid trolley provides an efficient and inexpensive structure by which heavy manual labor is completely avoided and effects the bobbin transfer without touching of the layers of the windings.

The embodiment utilizing the manually operated bobbin elevator with a lift slide and its associated bobbin gripper, as well as the lift drive for the lift slide offers the advantages of operation to effect bobbin transfer without use of manual labor and further provides a mechanism to attain exact positioning of the bobbin gripper (the bobbin receiving member) even in the shifting of heavy bobbins under load. This embodiment provides a combination of the features:

(a) the follower slide is movable synchronously with the lift slide;
(b) the follower slide can be stopped in any fixed vertical position by its brake;
(c) a blade spring is mounted on the follower slide and is deflectable in both directions in a vertical plane;
(d) a handle is mounted on the spring;
(e) a measuring unit is employed for measuring the spring deflection relative to the lift slide;
(f) a pneumatically operated control circuit is associated with the measuring unit in a manner which maintains the distance between the elevator slide and the spring at a substantially constant value.

The gripper mounted on the lift slide may be a mandrel onto which the wound bobbin and its bobbin tube are slid. Power-operated members or units may be employed to shift the wound bobbin onto the mandrel and/or shift off same from the mandrel. It is contemplated, however, that other grippers of known types and constructions, operated by hand and/or by power devices, may be utilized in lieu of the mandrel. Similarly, the bobbin elevator may be mounted on a travelling chassis of its own, optionally with a power drive to move the chassis horizontally. The brake for locking the follower slide in adjusted, fixed positions, e.g., along the length of a vertical support column, can be operated manually or, more preferably, by a switch mounted in the area of the handle. The brake may be any suitable type, e.g., electric, magnetic, hydraulic or pneumatic.

In a preferred form of the invention, the brake on the follower slide is operable by a switch positioned between the lift slide and the aforesaid spring. The release and setting of the brake is done in dependence on the spring's deflection with respect to the lift slide. Alternatively, the switch can be attained by using a measuring unit which measures the amount of spring deflection and transfers such signal through suitable control elements to the brake. The sensitivity of the switch or of such measuring units, or of the after-engaged control elements, could be adjusted so that release of the brake takes place only upon exceeding a certain threshold value of the deflection of the spring. The control system is, accordingly, rendered insensitive to certain unavoidable, unintentional hand movements on the part of the operating personnel as they attend the winding machines and transport units. In this type of bobbin elevator, a pneumatic lift drive, especially a pneumatic cylinder-piston unit, is advantageously employed.

Preferred embodiments of the invention are illustrated in the drawings, wherein:

Figure 1:
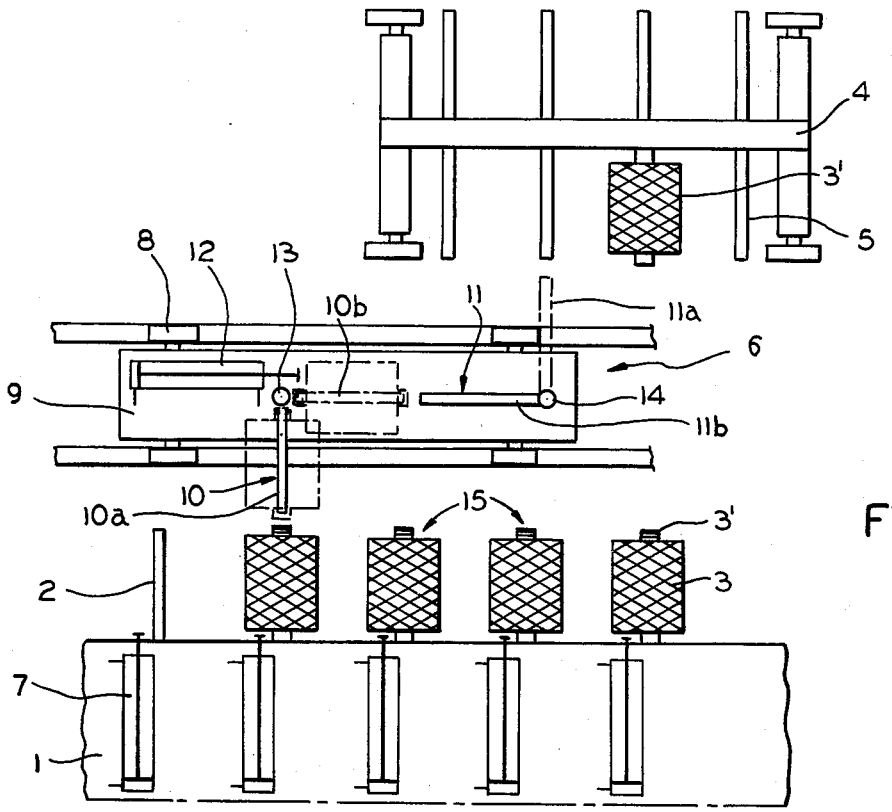
FIG. 1 is a top plan view of the bobbin transport device positioned between a winding machine (shown in fragment) and a first embodiment of a bobbin receiving carriage.

In FIG. 1, there is illustrated a section of a winding machine 1 with several winding stations (pirning heads) for synthetic filaments, e.g., yarns or threads. The tubes 15 on the bobbin spindles 2, after a certain winding time, i.e., when the cylindrical, cross-wound bobbins 3 have reached a prescribed diameter, must be regularly removed and replaced by new, empty tubes. The removed bobbins are slipped onto bobbin receiving mandrels 5 of a bobbin receiving carriage 4, which can itself, if need be, serve as bobbin runoff creel or by which the bobbins 3 can be conveyed to other processing or other textile working machines.

The bobbin weights reached nowadays with some winding machine types are over 30 kg. This is above the weights which can be handled repeatedly by the operating personnel themselves. Also, the bobbins of such weights can be handled only with difficulty without mechanical aids or lifting tools. To reduce the manual labor, therefore, between the winding machine 1 and the bobbin receiving carriage 4, there is provided the bobbin transport device 6 which is movable along the winding machine. At each winding spindle 2 a bobbin removal unit 7 acts on the tube or the machine-contiguous end of the bobbin winding 3. It preferably is a piston-cylinder unit 7 with the fluid operated piston pushing the piston rod against the end face of the winding to in turn push the winding and its tube off the spindle. Winding machines with such types of units are known (German utility model No. 74 22 357 or German Pat. No. 24 38 363).

The bobbin transport device 6 consists essentially of the carriage 9 movable on rollers 8 along the winding machine 1, on which carriage there are mounted two bobbin receiving members 10 and 11, swingable into first and second pivot positions 10*a*, 10*b* and 11*a*, 11*b*. The bobbin receiving members 10 and 11 are elevationally adjustable in carriers 13, 14 and can thus be adapted to the different heights or levels of the winding spindles 2 of winding machines 1 as well as different heights of the mandrels 5 on the bobbin receiving carriage 4.

For the taking off of a bobbin 3, which is clamped on the bobbin spindle 2, the first bobbin receiving member is swung in to the pivot position 10*a*, in which, after possible adjustment of the elevational setting, it aligns with the bobbin spindle 2. The piston-cylinder unit 7, after loosening of the chuck of the bobbin spindle 2, thrusts the wound bobbin onto the bobbin-receiving mandrel 10. The latter is pivoted 90° to the pivot position 10*b*, in which it aligns with the mandrel 11 in its pivot position 11*b*. The piston-cylinder shifting unit 12 engages the end face or circumference of the bobbin winding 3. As the piston rod progressively moves out of the cylinder, the free end of the piston rod pushes the bobbin 3 onto the bobbin receiving mandrel 11. After swinging of the latter through 90° into the position 11*a*, the wound bobbin is transferred onto an empty receiving mandrel 5 of the bobbin receiving carriage 4. The bobbin 3 is turned in this shifting process through 180° in axial direction. The thread reserve 3' (wound earlier on the side of the bobbin tube away from the winding machine 1) is now oriented inwardly toward the bobbin receiving carriage 4, so that the thread reserve 3' can be tied to the end of the adjacent bobbin whereby the thread drawn off overhead from the successive bobbins is not hampered.

The swinging movement of the bobbin receiving mandrels 10 and 11 on the carriers 13, 14 can advantageously be carried out also by pneumatic or hydraulic systems, the positioning and control of the movement courses being provided by known limit switches.

Figure 2:
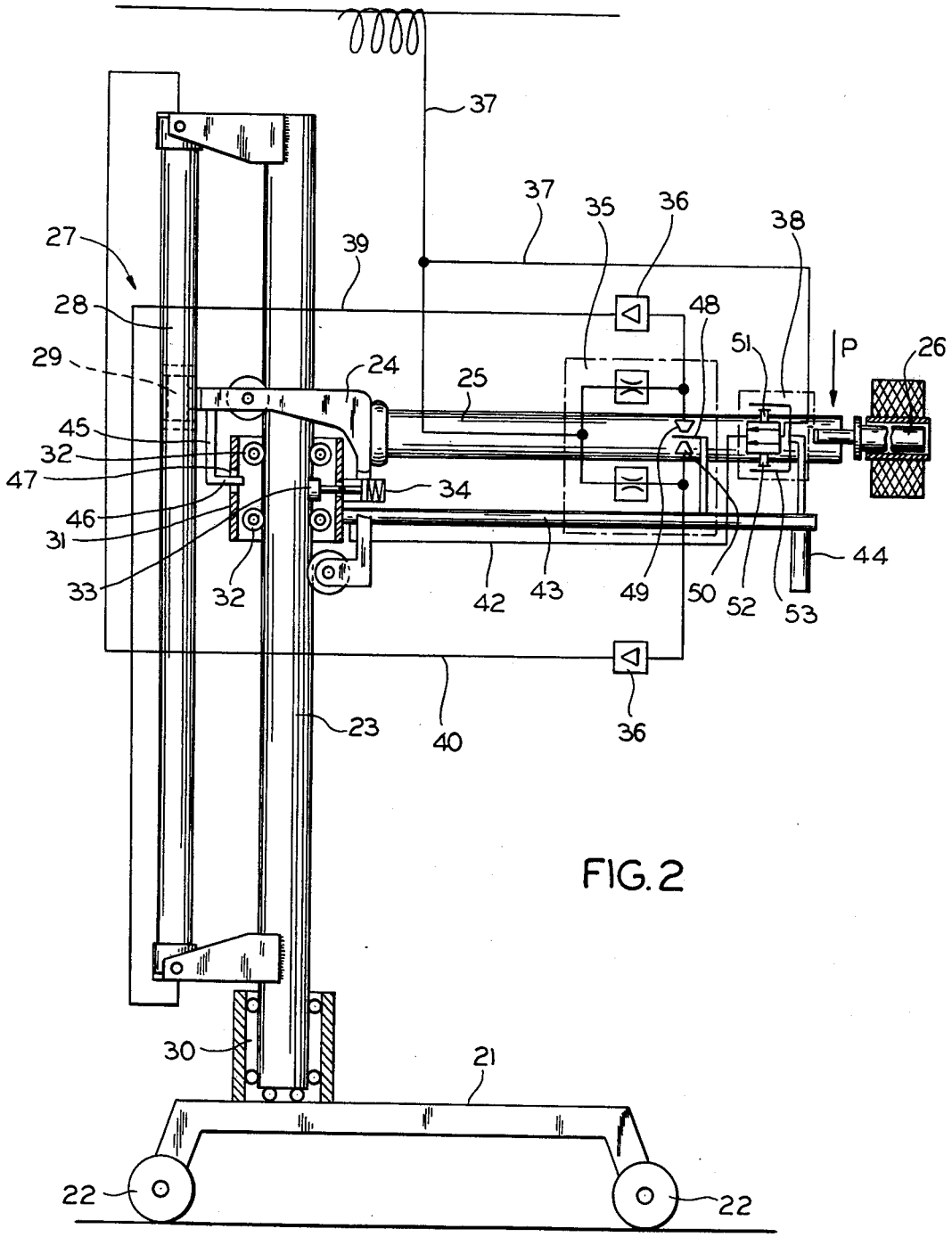
FIG. 2 is a schematic side elevation of a hand-operated bobbin elevator constituting a second embodiment.
Figure 4:
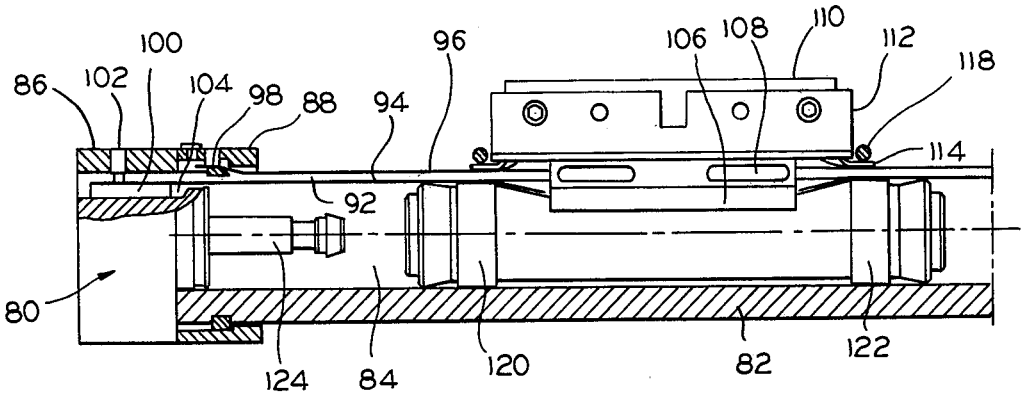
FIG. 4 is a longitudinal section of a known, Origa pneumatic, rodless piston-cylinder unit with the cylinder shown in longitudinal section and the other parts shown in full lines.
Figure 5:
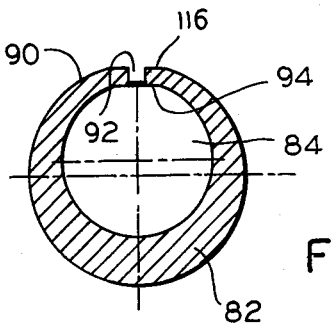
FIG. 5 is a transverse section through the cylinder per se.

FIG. 2 is a partially schematic illustration of the manually controlled bobbin elevator according to the invention. The carriage 21 on the wheels 22 is, for example, movable on rails (not represented). A vertical elevator column 23 is rotatably supported in the fixed hub 30. On the column 23, the lift slide 24 is movable in vertical direction. The lift slide 24 carries the laterally projecting cantilevered carrying arm 25. On its end there is the mandrel 26 serving as bobbin gripper or support. The lift slide 24 is moved up and down in vertical direction by elevator drive 27. The elevator drive consists of the cylinder 28, in which a rodless piston 29 is moved up and down pneumatically. The piston 29 is connected to the lift slide 24. Such rodless cylinder-piston units are obtainable, for example, from the firm of ORIGA CYLINDRAR AB, Kingsör, Sweden. The entire elevator drive is borne on the column 23 in the hub 30, so that the lift slide 24 and carrier arm 25 can be swung by rotation of the column 23. Through turning of the elevator column and orbiting of the mandrel 26, the mandrel can easily be aligned in the axial direction with the tube of the bobbin to be transported.

Further, on the column 23 the follower slide 31 is movable up and down on rollers 32 in vertical direction. The follower slide 31 is connected with the lift slide 24 by the arm 45. The pin 46 of the arm 45 seats in the oblong hole 47 of the follower slide, thereby assuring that the follower slide moves synchronously in the greater movements of the lift slide, but that, on the other hand, when the follower slide has been braked, the lift slide retains a limited freedom of movement corresponding to the length of the oblong hole. The follower slide can also have an independent drive and be connected with the lift slide via a follower control or regulating system. What is essential to the invention is merely that the follower slide synchronously participates in the movements of the lift slide, although the lift slide, with follower slide braked fast, has a slight freedom of movement.

The braking of the follower slide 31 takes place through brake 33 which can be locked and disengaged via cylinder-piston unit 34 or any other suitable means. Further, a flexible cantilever beam 43 acting as a spring is mounted on the follower slide 31. The cantilever beam 43 has on its free end a handle 44. For the measurement of the relative movement between the cantilever beam 43, on the one hand, and the rigid carrying arm 25, on the other hand, a measuring device 35 is mounted on one of these, as is the switch 38.

When the lift slide 24 with the carrying arm 25 is to be moved up or down, the operating person grasps the handle 44 and moves his hand in the desired direction. The flexible cantilever 43 is deflected with respect to the rigid carrying arm 25. This deflection is detected, in the first place, by switch 38, insofar as the deflection exceeds a certain amount in the one or the other direction. By operation of the switch 38 the brake is released. On the other hand, by the deflection of the cantilever beam 43, the measuring unit 35 is operated. The measuring unit 35 detects simultaneously the direction of the deflection. The direction-dependent output signal 39 or 40 of the measuring unit 35 is supplied over suitable control elements to the elevator drive (cylinder 29) in the sense of the upward movement (signal 39) or downward movement (signal 40).

When the desired elevation is reached, the operator lets go the handle 44. Thereby the switch 38 is switched off, so that the brake again is energized and securely locks the follower slide in fixed position on the column 23. The measuring unit 35 now regulates the distance of the carrying arm 25 relative to the cantilever 43 at a prescribed value, whereupon direction-dependent output signals 39, 40 of the measuring unit 35 cease.

If the rigid carrying arm 25 in a driven elevational position is loaded by a bobbin or else relieved of the bobbin, its elevational position would also change, especially since the carrier arm 25 itself is not absolutely rigid and also since the lift drive, especially the pneumatic cylinder-piston unit, operates in dependence on the load. With change of the load, therefore, the carrying arm 25 would execute a movement relative to the cantilever beam 43 braked in fixed position by brake 33. Here the measuring unit 35 would be actuated, which measures the deviation of the carrying arm 25 from its desired position and, again, supplies the direction-dependent signal 39 or 40 for the reregulation of the elevational position of the carrying arm 25 of the cylinder-piston unit 28, 29, whereby the carrying arm 25 will retain its desired position constantly, even with changing load.

In the embodiment shown, a pneumatic elevator drive is supplied with compressed air supply via tube 37. The measuring unit 35 consists, for example, of a nozzle/bounce-plate system. The nozzle 49 for the upward movement signal 39 and nozzle 50 for the downward movement signal 40 are fastened to the rigid carrying arm 25. The bounce plate 48 is fastened to the flexible cantilever beam 43. Relative movements between cantilever beam 43 and carrying arm 25 lead to pressure changes in front of the nozzle 49 or 50. These pressure changes are supplied via amplifier 36 of the cylinder-piston unit 28 or 29 as direction-dependent signals 39 and 40. Other directionally dependent path measurement systems are also usable.

The switch 38 consists, in the embodiment shown, of a pneumatic valve that is controlled on and off by the sensor 51 or 52 and is connected via line 42 with the cylinder-piston 34 of the brake 33. The sensors are actuated by the U-shaped yoke 53 which is fastened to the flexible cantilever beam 43. The distance between the shanks of the yoke is somewhat greater than the distance between the heads of the sensors 51 and 52, so that the brake is released only with a presettable, desired amount of change of the deflection between carrying arm and cantilever beam 43. It thus is possible to negate unintended hand movements and slight saggings of the carrying arm.

It is obvious that the switching of the brake can also be done via the measuring unit 35 by an arrangement such that the brake is releasable or engageable through derivation of the output signals 39 and 40, optionally via a threshold value switch in common for both signals.

The advantage of the invention and of the embodiment of FIG. 2 lies in a technically reliable and economical low-cost hand-operated control and regulating system, whereby the bobbins to be transported can be raised and lowered in proportion to a hand movement according to direction, distance and speed and also can be positioned reliably at the requisite height, once it is reached.

Figure 3:
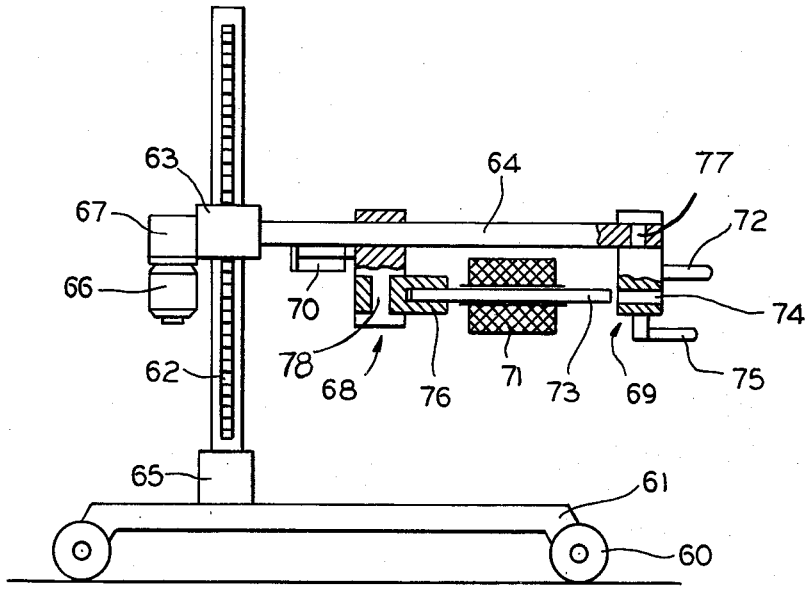
FIG. 3 is a side elevation of another bobbin elevator integrated into a bobbin transport device according to the invention with parts thereof in cross-section and other parts shown schematically.

FIG. 3 shows a bobbin transport device integrated into a bobbin elevator. The schematically represented bobbin elevator is mounted on the carriage 61, equipped with wheels 60 and/or rails (not shown) to be movable along a winding machine or processing machine in about same manner as the transport device 6 in FIG. 1. The elevator column 62 (constructed as a gear rack), the lift slide 63 and the carrying arm 64 are rotatably borne on the carriage 61 in the bearing hub 65. The lift slide 63 can be driven to the desired height by a pinion gear (not shown) driven by the electric motor 66 and the reducing gear box unit 67, analogously to FIG. 2, and arrested in this position. The carrying arm 64 can thus be positioned at any desired height.

On the carrying arm 64 a slide 68 has a first auxiliary carrier 76 pivotally mounted on the shaft 78 and a bobbin receiving member 73 removably inserted in carrier 76, as well as a second auxiliary carrier 69 pivotally mounted by means of shaft 77, which carriers are aligned with one another in the pivot positions shown in FIG. 3, the horizontal spacing between carriers 76 and 69 being variable by means of the sliding adjustment unit 70. This latter unit 70 is constructed, just as the unit 12 of FIG. 1, as a piston-cylinder unit and engages the slide 68. However, it can also be a trolley movable with the bobbin receiving unit on the carrying arm 64. This has the advantage that the movement of the bobbin to be shifted between the bobbin receiving pivot members 69 and 76 can be controlled more simply.

The auxiliary carrier 69, because it is mounted initially by the shaft 77 on the carrying arm 64, can be swung by hand grip 72 into the intended pivot positions, i.e. to the position shown in FIG. 3 to be aligned with carrier 76 in making a transfer of the bobbin 71, or through 90° to a second position where the bobbin is to be transferred to the carriage or creel 4 (compare positions 11*a* and 11*b* in FIG. 1).

In first taking a bobbin 71 from the machine, the carrier 76 and the inserted mandrel 73 are pivoted approximately 90° away from arm 64 and aligned with one bobbin spindle 2 (compare position 10*a* in FIG. 1), and after the bobbin is received onto the mandrel 73, it is swung or pivoted 90° back to the position shown in FIG. 3.

Figure 8:
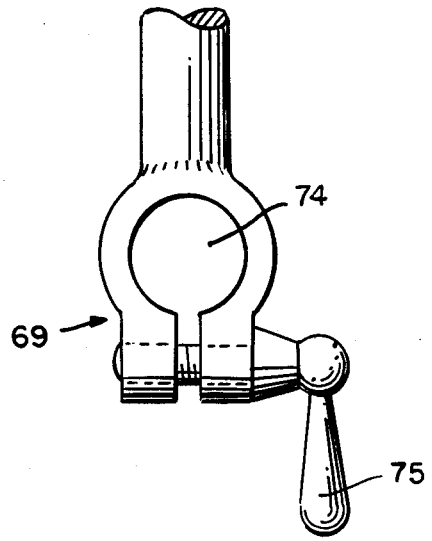
FIG. 8 is further included to illustrate in a front elevation the structure of a suitable toggle grip used in FIG. 3 to tightly clamp a bobbin receiving mandrel.

Through the operation of the unit 70, the slightly conical exposed end of the bobbin receiving mandrel 73 holding the bobbin 71 is slid or pushed into the passage 74, where it is clamped tight with the toggle grip 75. FIG. 8 illustrates one suitable embodiment of this toggle grip 75 which can be rotated to reduce or enlarge the size of the passage 74. The passage 74 can also be a tension jaw actuatable by a piston-cylinder unit (not shown).

In the sliding return of the unit 70 along arm 64, the bobbin receiving mandrel 73 (held, for example by a magnet in the passage of the auxiliary carrier 76 on the slide 68) is released. The carrying arm 64 of the bobbin elevator can now be raised, lowered or turned with respect to the carriage 61 toward a bobbin receiving carriage or creel 4 which may not be exactly positioned as shown in FIG. 1, depending upon available equipment. The bobbin 71 is slid onto a free bobbin receiving mandrel 5 after first aligning mandrel 73 therewith, e.g. by swinging mandrel 73 outwardly about 90° from the carrying arm 64 (position 11a in FIG. 1). In this manner, the complete transfer of the bobbin from machine 1 to creel 4 can be made without its being necessary for operating personnel to physically exert themselves in any unreasonable extent.

The bobbin receiving arrangement 69 is then swung back again to the position shown in FIG. 3, and the empty bobbin receiving mandrel 73 is transferred back to the auxiliary carrier 76 on the slide 68 to be ready for taking over the removal of the next bobbin.

A known, pneumatic rodless piston-cylinder unit 80 can be used in the embodiment of FIG. 2 and comprises an elongated hollow cylinder 82 with an off-center, cylindrical, axial bore 84. Each axial end of the cylinder bears a cap member 86, the ring sleeve 88 of which is mounted about the end of the cylinder 82.

The thinnest wall segment 90 of the cylinder 82 has a longitudinal slot 92 running from end to end. This slot is sealed by a flexible, inner sealing strip 94 and an outer, flexible, sealing strip 96. A seal ring 98 is mounted in an annular groove in the cylinder and clampingly engages the end of the outer strip 96.

The end of the inner strip 94 lays a strip lock member 100 and is held thereon by the setscrew 102. An end wall disc 104 closes off the end of the cylinder passage 84.

The rodless piston 106 has a slide rail member 108 which rides along opposite edges of the slot 92. This member carries a rectangular frame 112 which holds and houses a rectilinear yoke bar 110, which is removably held in the frame by bolts or screws. The leading and trailing edges of the yoke bar 110 carry pressure plates 114, which slide upon the outer strip 96 and press it against the flat, narrow faces 116 extending longitudinally along the outer face of the cylinder 82 adjacent the slot 92. An O-ring 118 holds the pressure plates 114 against the outer strip.

Figure 6:
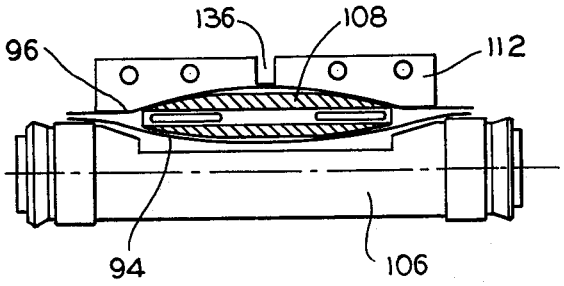
FIG. 6 is a side elevation, partly in vertical section, of the rodless piston with its slide rail segment in section.

As can be seen in FIG. 6, the slide rail member 108 runs between the strips 94 and 96 and spreads them in the area between the piston heads 120 and 122. Pressurized air is admitted or exhausted from the respective ends of the cylinder bore 84 via the tubular nozzle 124, which in turn is in communication with an air passage (not shown) in the disc 104.

Figure 7:
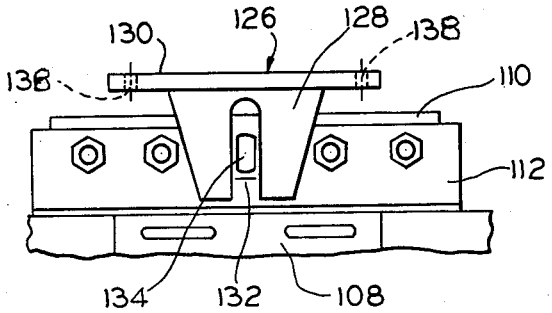
FIG. 7 is a side elevation of a segment of the piston with a mounting bracket thereon.

As shown in FIG. 7, a structure to be moved with the rodless piston 106 may be mounted thereon by the use of the mounting bracket 126. This bracket has a pair of legs 128 which straddle the rectangular frame 112 and which are connected by the mounting plate 130. Each leg 128 has a slot 132. A rod or pin 134 projects from opposite sides of the yoke bar 110 through the notches 136 in the frame 112 and into the slots 132. A fastener (not shown), e.g., a nut, is used to secure the mounting bracket 126 on the yoke bar/frame structure.

The mounting plate 130 has holes 138 useful for bolting the bracket-carried member to the bracket. In the case of the embodiment of FIG. 2, the lift slide 24 is the member which is bolted to the mounting bracket 126.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. Bobbin transport apparatus comprising a first, pivotable bobbin-receiving member, means for pivoting said member about a first axis between a first position in which it is aligned with a wound bobbin on a winding machine and a second position, a second, pivotable bobbin-receiving member, means for pivoting said second member about a second axis between a first position in which it is aligned with said first member in its second position and a second position of said second member in which said wound bobbin, after its transfer from said first member to said second member, may be doffed from said second member, and transfer means for shifting said wound bobbin from said first member, while in its second position, to said second member, while in its first position.

2. Bobbin transport apparatus as claimed in claim 1 wherein said respective members have vertical pivot axes, whereby the respective members are pivotable in respective horizontal planes.

3. Bobbin transport apparatus as claimed in claim 2, wherein one of said members is mounted on said apparatus by means permitting horizontal, adjustable movement of one of said members toward or away from the other member.

4. Bobbin transport apparatus as claimed in claim 1, wherein said transfer means embodies a member adapted to engage the winding tube of said wound bobbin or the winding thereon to effect said shifting.

5. Bobbin transport apparatus comprising a bobbin-receiving member, first means, having releasable gripping means for said member, for swinging said member and a wound bobbin thereon between a first position in which said member is aligned with a wound bobbin on a winding machine and a second position, second means, having releasable gripping means for said member, for swinging said member and the wound bobbin thereon, after release of said member by said first means, from a first position of said second means in which said member and the wound bobbin thereon may be shifted from said first means to said second means, to a second position in which said wound bobbin may be doffed from said member, and means for shifting said member and the wound bobbin thereon from said first means to said second means.

6. Bobbin transport apparatus as claimed in claim 5, slide or trolley means mounting said one of said first means and second means on said apparatus for relative linear movement between said first means and said second means, said releasable gripping means of said first means embodying an auxiliary carrier rotatably mounted thereon, and said gripping means of said second means embodying a second auxiliary carrier rotatably mounted on said apparatus.

7. Bobbin transport apparatus as claimed in claim 6, wherein said bobbin-receiving member is a mandrel insertable into the winding tube of a wound bobbin.

8. Bobbin transport apparatus as claimed in claim 1, wherein at least one of said bobbin-receiving members is a mandrel insertable into the winding tube of a wound bobbin.

9. Bobbin transport and elevator apparatus comprising a vertical support member, a lift member mounted on said support member for vertical, up-and-down movement thereon, a bobbin gripper on said lift member, a follower member mounted on said vertical member and joined with said lift member for synchronous up-and-down movement with said lift member, releasable brake means on said follower member for arresting said lift and follower members on said vertical member, power drive means for moving said lift member and said follower member up or down on said support member, a spring mounted on said follower member and deflectable in the vertical directions, a handle on said spring for grasping by an operator to move said handle either up or down, and measuring means operatively associated with said spring to sense the direction of up or down movement of said handle and operatively associated with said power drive means to activate the latter in a manner seeking to maintain a substantially constant spacing between said spring and said lift member whenever said operator raises or lowers said handle.

10. Bobbin transport apparatus as claimed in claim 9, and manually-operated switch means contiguous to said handle for activating said brake means.

11. Bobbin transport apparatus as claimed in claim 9, switch means operatively associated with said spring and with said brake means for setting and releasing said brake means at predetermined deflections of the spring.

12. Bobbin transport apparatus as claimed in claim 9, wherein said power drive means is a pneumatic cylinder-piston unit.

13. Bobbin transport apparatus as claimed in claim 9, a rigid arm projecting laterally from said lift member and having thereon a bobbin-receiving member, and said spring being a flexible, elongated member extending laterally from said follower member and parallel with said rigid arm.

14. Bobbin transport apparatus as claimed in claim 9, and means mounting said lift member, said power drive means and said follower member for pivotal movement thereof about a vertical axis of rotation.

15. Bobbin transport apparatus as claimed in claim 5 wherein said first means and said second means are mounted on a horizontal arm, and lift means operatively associated with said arm for moving said arm up and down to position said arm and first and second means at various levels.

16. Bobbin transport apparatus as claimed in claim 15, and means to pivot said horizontal arm about a vertical axis.

17. Bobbin transport apparatus as claimed in claim 15, wherein the respective releasable gripping means of said first means and said second means lie in a common horizontal plane in which said bobbin receiving member is swung by said first means and said second means.

18. Bobbin transport apparatus as claimed in claim 15 wherein said means for shifting said member and the wound bobbin thereon comprises slide or trolley means movable along said arm, one of said first means and said second being mounted on said slide or trolley means and the other of said means being mounted on said arm.

* * * * *